US008295731B2

(12) United States Patent
Noh

(10) Patent No.: US 8,295,731 B2
(45) Date of Patent: Oct. 23, 2012

(54) DEVELOPING CARTRIDGE AND IMAGE FORMING APPARATUS INCLUDING THE SAME

(75) Inventor: Joo-hwan Noh, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1207 days.

(21) Appl. No.: 12/021,753

(22) Filed: Jan. 29, 2008

(65) Prior Publication Data

US 2008/0181659 A1 Jul. 31, 2008

(30) Foreign Application Priority Data

Jan. 31, 2007 (KR) ..... 10-2007-0009998

(51) Int. Cl.
*G03G 21/18* (2006.01)

(52) U.S. Cl. ..... 399/113

(58) Field of Classification Search ..... 399/109, 399/110, 111, 113, 114, 115, 116, 119, 120, 399/126

See application file for complete search history.

(56) References Cited

U.S. PATENT DOCUMENTS

| | | | | |
|---|---|---|---|---|
| 5,697,022 | A * | 12/1997 | Matsuda et al. | 399/102 |
| 2005/0220482 | A1 | 10/2005 | Ishii | |
| 2006/0245786 | A1 | 11/2006 | Suzuki | |
| 2006/0291895 | A1 | 12/2006 | Fukuta et al. | |

FOREIGN PATENT DOCUMENTS

| | | |
|---|---|---|
| JP | 6-130739 | 5/1994 |
| JP | 9-288413 | 11/1997 |
| JP | 11-143203 | 5/1999 |
| JP | 2005-292457 | 10/2005 |
| JP | 2006-39431 | 2/2006 |
| JP | 2006-308802 | 11/2006 |
| KR | 96-38339 | 12/1996 |
| KR | 10-2006-0009208 | 1/2006 |

OTHER PUBLICATIONS

Notice of Allowance mailed in Korean Patent Application No. 10-2007-0009998 on Sep. 1, 2011.

* cited by examiner

*Primary Examiner* — Mark R Gaworecki

(74) *Attorney, Agent, or Firm* — Stanzione & Kim, LLP

(57) ABSTRACT

A developing cartridge includes a photosensitive body, a developing unit which is disposed in parallel with the photosensitive body to develop the photosensitive body by toner, a cleaning unit to clean waste toner attached to the photosensitive body, a charging unit to charge the photosensitive body, and a supporting casing which comprises an accommodating main body having a first opening through which at least two components of the photosensitive body, the developing unit, the cleaning unit and the charging unit can pass in common, and a supporting unit to support the components accommodated inside the accommodating main body.

22 Claims, 14 Drawing Sheets

DEVELOPING CARTRIDGE AND IMAGE FORMING APPARATUS INCLUDING THE SAME

CROSS-REFERENCE TO RELATED APPLICATIONS

This application claims priority under 35 U.S.C. §119(a) from Korean Patent Application No. 10-2007-0009998, filed on Jan. 31, 2007 in the Korean Intellectual Property Office, the disclosure of which is incorporated in its entirety herein by reference.

BACKGROUND OF THE INVENTION

1. Field of the Invention

The present general inventive concept relates to a developing cartridge and an image forming apparatus including the same, and more particularly, to a developing cartridge capable of easily attaching and detaching accommodated components.

2. Description of the Related Art

In general, an electrophotographic image forming apparatus forms an image on a printing medium through a series of charging-exposure-developing-transferring-fusing processes. The electrophotographic image forming apparatus generally comprises a developing cartridge that is detachably provided to store toner.

As illustrated in FIGS. 1 and 2, a conventional developing cartridge 1 is provided with a supporting casing 10, a cover casing 20, a right side frame 30, a left side frame 40, and an accommodated component 50 which is accommodated in the supporting casing 10.

As illustrated in FIGS. 1 and 2, an upper side of the supporting casing 10 is opened so as to mount the accommodated components 50 to be described later. Also, on a lower side of the supporting casing 10 is formed a transfer opening 18 so that toner on a surface of a photosensitive body 155 can be transferred to a printing medium while a developing cartridge 1 is operated, the surface of the photosensitive body 55 being exposed to the outside.

The cover casing 20 covers up an opening of an upper side of an accommodating main body 11 of the supporting casing 10, and forms a waste toner storing room 5 on a first side, and forms a toner storing room 3 on a second side. Between the two rooms is disposed a sealing member 54 to prevent toner and waste toner accommodated in the toner storing room 3 and the waste toner storing room 5 from being leaked. Referring to 58*a* and 58*b* in FIG. 2, a sealing film is provided to be in contact with a developing roller 52 and a photosensitive body 55 to seal the toner storing room 3 and the waste toner storing room 5.

The accommodated component 50 comprises a photosensitive body 55 on which an electrostatic latent image is formed by exposure, a charging roller 51 which charges the surface of the photosensitive body 55 to a predetermined electric potential, a developing roller 52 which develops the electrostatic latent image with toner, a supplying roller 56 which is accommodated in the toner storing room 3 to supply toner to the developing roller 52 and frictionally charge the toner, and a cleaning unit 53. The reference numerals 57*a* and 57*b* in FIG. 2 denote a doctor blade and a bracket that supports the doctor blade. The description of the mounting method of the doctor blade 57*a* and the bracket 57*b* will be omitted, as it is the same as that of the cleaning unit 53.

As illustrated in FIG. 2, the cleaning unit 53 is provided with a cleaning blade 53*a* which scrapes and cleans waste toner remaining on a surface without being transferred, being in contact with the surface of the photosensitive body 55, and a supporting plate 53*b* which supports the cleaning blade 53*a*.

Here, the developing cartridge 1 is assembled in an order of an accommodated component 50 installing process for arranging or mounting the accommodated component 50 in/to the supporting casing 10, and the cover casing 20 coupling process for seal-coupling the cover casing 20 to the supporting casing 10 by the sealing member 54.

Finally, the right side frame 30 and the left side frame 40 are coupled to sides of the supporting casing 10. Accordingly, the position of some accommodated components 50, 52, 55, and 56 disposed inside the supporting casing 10 in a temporarily-mounted state is determined, and then the developing cartridge 1 is completed.

As illustrated in FIG. 1, the accommodated component 50 is installed in the supporting casing 10 in a direction from an upper side to a lower side M. As illustrated in FIG. 2, the supplying roller 56 is disposed in the supplying roller accommodating room 56S, the photosensitive body 55 is disposed on the photosensitive body supporting plate 13 (FIG. 2), and the developing roller 52 is disposed between the photosensitive body 55 and the supplying roller 56. The supplying roller 56, the photosensitive body 55, and the developing roller 52 are in a temporarily-mounted state, and their positions are determined after the side frames 30 and 40 (to be described later) are coupled.

Meanwhile, as illustrated in FIG. 5, the cleaning unit 53 is mounted to a cleaning supporting unit 17 provided on opposite sides of a lengthwise direction of the cleaning unit 53 of the accommodating main body 11 by a coupling unit U.

Also, as illustrated in FIGS. 3 and 4, the charging roller 51 is mounted to charging roller supporting units 12L and 12R that are provided on right and left sides of the accommodating main body 11.

The charging roller supporting units 12L and 12R (FIG. 3) have a through hole 12*a* through which a charging roller shaft 51*a* can pass. The through hole 12*a* has a groove 12*b* corresponding to a separation preventing projection 7*a* of a charging roller shaft bushing 7. Also, as illustrated in FIG. 4, the charging roller shaft bushing 7 has a lower side that is opened in a direction in which the charging roller shaft 51*a* is inserted. Also, the charging roller shaft bushing 7 has the separation preventing projection 7*a* to prevent the charging roller shaft bushing 7 from being separated in an axial direction.

First, first end portions of two coil springs 6 are coupled to a coupling projection 12*c* of the right and the left charging roller supporting units 12L and 12R. Then, second end portions of the coil springs 6 are coupled with the charging roller shaft bushing 7, respectively. Thereafter, opposite end portions of the charging roller shaft 51*a* are inserted into the charging roller shaft bushing 7.

However, as illustrated in FIG. 4, since the coil springs 6 apply an elastic force to the charging roller shaft bushing 7 downwardly, one end portion of the charging roller shaft 51*a* is first inclined to be inserted into the charging roller shaft bushing 7, and then the other end portion is inclined to be inserted into the other side charging roller shaft bushing 7 in the inserted state, thereby the charging roller 51 being mounted completely.

Meanwhile, as illustrated in FIGS. 1 and 2, after the installing process of the accommodated component 50 is finished, the cover casing 20 is coupled to the supporting casing 10. Also, the sealing member 54 is disposed between the cover casing 20 and the supporting casing 10 along the border of the waste toner storing room 5 and the toner storing room 3.

After the cover casing 20 is coupled, the side frames 30 and 40 are coupled to the right and the left side of the accommodating main body 11, respectively. Since the left side frame 40, for example, is the same as the right side frame 30, only the right side frame 30 will be described hereinafter.

As illustrated in FIG. 3, in the right side frame 30 are formed a photosensitive body inserting boss 31, and a supplying roller shaft hole 35 which rotationally supports a supplying roller shaft (not illustrated) projected on the side of the accommodating main body 11. The photosensitive body inserting boss 31 passes through a main body position determining hole 14R of the accommodating main body 11 to be inserted into a photosensitive body shaft hole 55*a* (FIG. 1).

Also, in the right side frame 30 is provided a developing roller position determining unit 33 which determines a position of a right end portion of the developing roller shaft 52*a*. In the developing roller position determining unit 33 is provided an accommodating room 33*a* that accommodates a right end portion of the developing roller shaft 52*a* and a developing roller shaft bushing (not illustrated) into which the right end portion of the developing roller shaft 52*a* is inserted. Also, between the developing roller shaft bushing (not illustrated) and the spring supporting projection 33*b*, is disposed a coil spring (not illustrated) to elastically support the developing roller 52 toward the photosensitive body 55.

The position determining projection 32 of the right side frame 30, the photosensitive body inserting boss 31, the supplying roller shaft hole 35 and the developing roller position determining unit 33 are inserted into the position determining hole 15 of the accommodating main body 11, the photosensitive body shaft hole 55*a* in the temporarily-mounted state, the supplying roller shaft (not illustrated), and the developing roller shaft 52*a*, respectively. Accordingly, the position of the rotational center of the accommodated components 55, 56 and 52 which have been in the temporarily-mounted state is determined. Here, the position determining hole 15 is provided in the shape of a long hole in a transverse direction (refer to J in FIG. 7) of the accommodating main body 11, and although the photosensitive body inserting boss 31 is inserted into the main body position determining hole 14R, the relative position of the right side frame 30 can be precisely controlled.

Further, a bolt is inserted to and couples the coupling holes 34*b* and 16*b* formed in the right side frame 30 and the accommodating main body 11 respectively, thereby detachably coupling the components.

However, if an inferior component is detected among the accommodated components after the cover casing 20 is coupled to the supporting casing 10 in a manufacturing process of the conventional developing cartridge 1, or if an inferior component is detected among the accommodated components during using the developing cartridge 1, the cover casing 20 needs to be opened for replacing the inferior component. Also, since the sealing member 54 needs to be mounted again after the accommodated component 50 is replaced, it is not easy to replace the accommodated component 50. Accordingly, an assembling time and a component cost for the developing cartridge 1 may increase.

Also, as described above, the charging roller shaft 51*a* is inclined so that the charging roller 51 can be mounted, thereby lowering an assembling operation efficiency and increasing an assembling time. Also, since the mounting process of the charging roller 51 is complicated, it cannot be automated by a robot. Accordingly, it is difficult to automate an assembling process of the developing cartridge 1.

SUMMARY OF THE INVENTION

The present general inventive concept provides a developing cartridge capable of easily attaching and detaching accommodated components and an image forming apparatus including the same.

The present general inventive concept provides a developing cartridge that can reduce a number of assembling points and an image forming apparatus including the same.

The present general inventive concept provides a developing cartridge that can be assembled in an automation process and an image forming apparatus including the same.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing a developing cartridge, comprising a photosensitive body, a developing unit which is disposed in parallel with the photosensitive body to develop the photosensitive body by toner, a cleaning unit to clean waste toner attached to the photosensitive body, a charging unit to charge the photosensitive body, and a supporting casing which comprises an accommodating main body having a first opening through which at least two components of the photosensitive body, the developing unit, the cleaning unit and the charging unit can pass in common, and a supporting unit to support the components accommodated inside the accommodating main body.

The accommodating main body may have a second opening that is opened to an opposite side of the first opening, and may further comprise a cover casing to close the opening.

The cover casing and the accommodating main body may be coupled by an ultrasonic or a vibration welding.

The accommodating main body may be provided so that the accommodated components can move from the first opening to a supporting position of the supporting unit along a linear mounting path.

The accommodating main body may comprise a guide to guide at least one of the accommodated components to the supporting position along the linear mounting path.

The guide may comprise a bending guide to guide at least one of the accommodated components along a bending mounting path bent from the linear mounting path.

The cleaning unit may comprise a cleaning blade to contact with a circumference surface of the photosensitive body, and a blade supporting plate to support the cleaning blade, and the supporting unit may comprise a blade supporting unit which may be coupled to the blade supporting plate.

The photosensitive body has a photosensitive body shaft, the developing unit may comprise a developing roller having a developing roller shaft in parallel with the photosensitive body shaft, and the charging unit may comprise a charging roller which may have a charging roller shaft in parallel with the photosensitive body shaft and contact-charges the photosensitive body.

The developing cartridge may further comprise a plurality of side frames which rotationally support the photosensitive body shaft, the developing roller shaft, and the charging roller shaft and which may be detachably coupled to opposite sides of the supporting casing.

The developing cartridge may further comprise a plurality of position determining projections which are provided in at least one of the side frame and the supporting casing and determine the relative position of the side frame with respect to the supporting casing and a plurality of position determining holes which are provided in the other one of the side frame and the supporting casing and into which the position determining projection is inserted.

At least one of the plurality of position determining holes may be provided as an elongated hole.

The developing cartridge may further comprise an elastic member to elastically support the charging roller shaft toward the photosensitive body.

The foregoing and/or other aspects and utilities of the present general inventive concept can be achieved by providing an image forming apparatus having a main body, the apparatus comprising a developing cartridge accommodated in the main body, the developing cartridge comprising a photosensitive body having a photosensitive body shaft, a developing unit to develop the photosensitive body by toner, the developing unit including a developing roller having a developing roller shaft in parallel with the photosensitive body shaft, a cleaning unit to clean waste toner attached to the photosensitive body, a charging unit to charge the photosensitive body, the charging unit including a charging roller which has a charging roller shaft in parallel with the photosensitive body shaft and contact-charges the photosensitive body and a supporting casing which comprises an accommodating main body having a first opening through which at least two components of the photosensitive body, the developing unit, the cleaning unit and the charging unit can pass in common, and a supporting unit to support the components accommodated inside the accommodating main body; and a transferring unit to face the photosensitive body of the developing cartridge and a medium feeding unit to feed a printing medium between the photosensitive body and the transferring unit.

The foregoing and/or other aspects and utilities of the general inventive concept may also be achieved by providing a developing cartridge comprising a supporting casing to support one or more replaceable units, a cover casing coupled to the supporting casing and a plurality of side frames detachably coupled to opposite sides of the supporting casing so that at least one of the plurality of side frames is detached from the supporting casing to attach to and/or detach the one or more replaceable units from the supporting casing without moving the cover casing relative to the supporting casing.

The foregoing and/or other aspects and utilities of the general inventive concept may also be achieved by providing an image forming apparatus comprising a frame and a developing cartridge coupled to the frame comprising a charging roller having a shaft and a shaft bushing, a supporting casing having an access opening through which the charging roller is at least one of inserted or removed and a plurality of charging roller supporting units disposed on opposite sides of the supporting casing so that at least one of the charging roller supporting units having a through hole aligned with the access opening, a groove on each side of the through hole and a separation preventing projection having a shape corresponding to the grooves to prevent the shaft bushing from being separated in an axial direction from the at least one of the charging roller supporting units.

The foregoing and/or other aspects and utilities of the general inventive concept may also be achieved by providing a developing cartridge comprising a charging roller having a shaft and a shaft bushing, a supporting casing having an access opening through which the charging roller is at least one of inserted or removed and a plurality of charging roller supporting units disposed on opposite sides of the supporting casing so that at least one of the charging roller supporting units having a through hole aligned with the access opening, a groove on each side of the through hole and a separation preventing projection having a shape corresponding to the grooves to prevent the shaft bushing from being separated in an axial direction from the at least one of the charging roller supporting units.

The foregoing and/or other aspects and utilities of the general inventive concept may also be achieved by providing a method of attaching or detaching a replaceable unit in a developing cartridge comprising detaching at least one side frame from a supporting casing to provide an access opening and at least one of attaching to and detaching from a supporting casing without moving a cover casing relative to the supporting casing through the access opening a replaceable unit.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
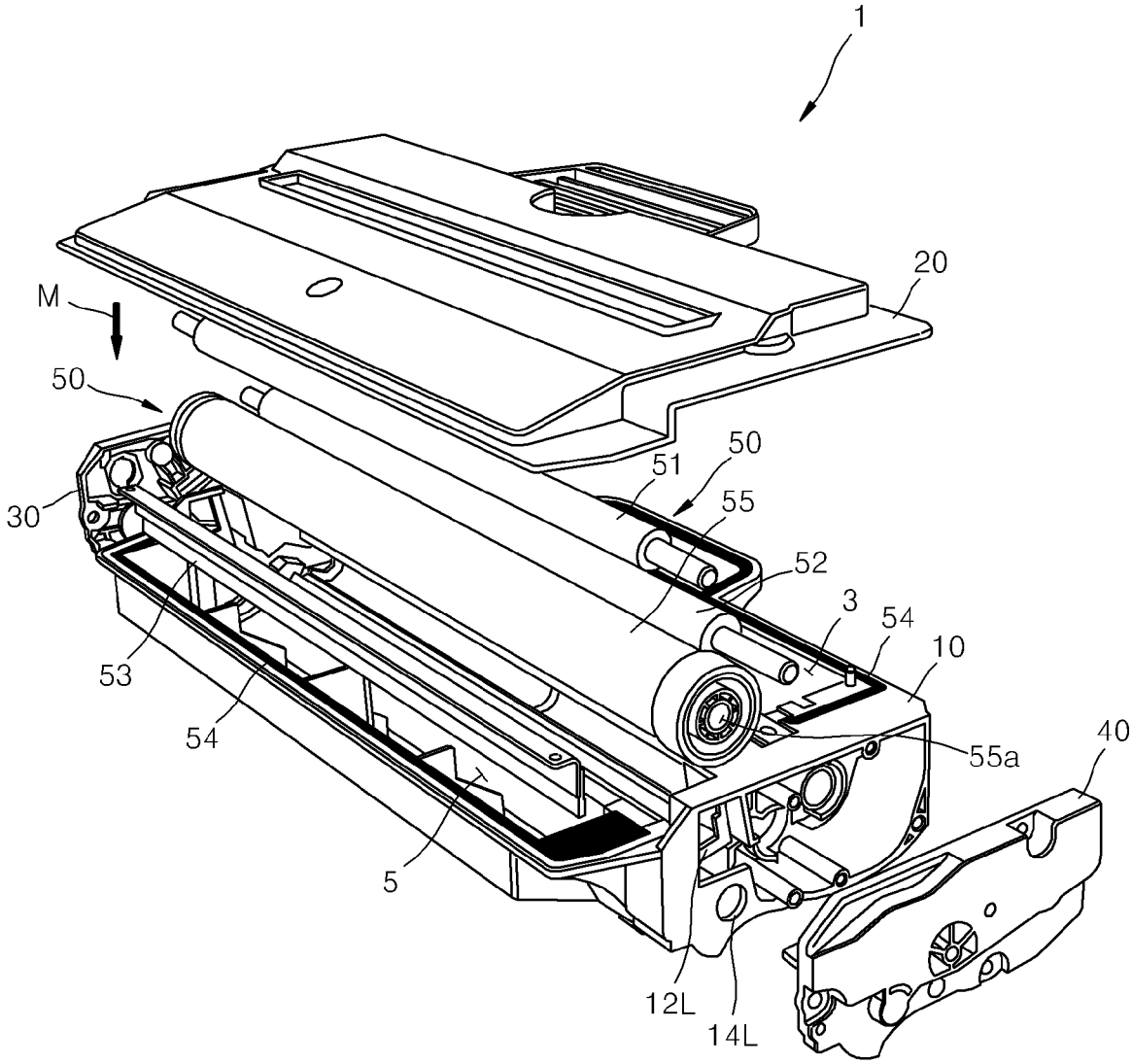
FIG. 1 (RELATED ART)
FIG. 1 is a perspective view schematically illustrating an assembling process of a conventional developing cartridge.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 6:
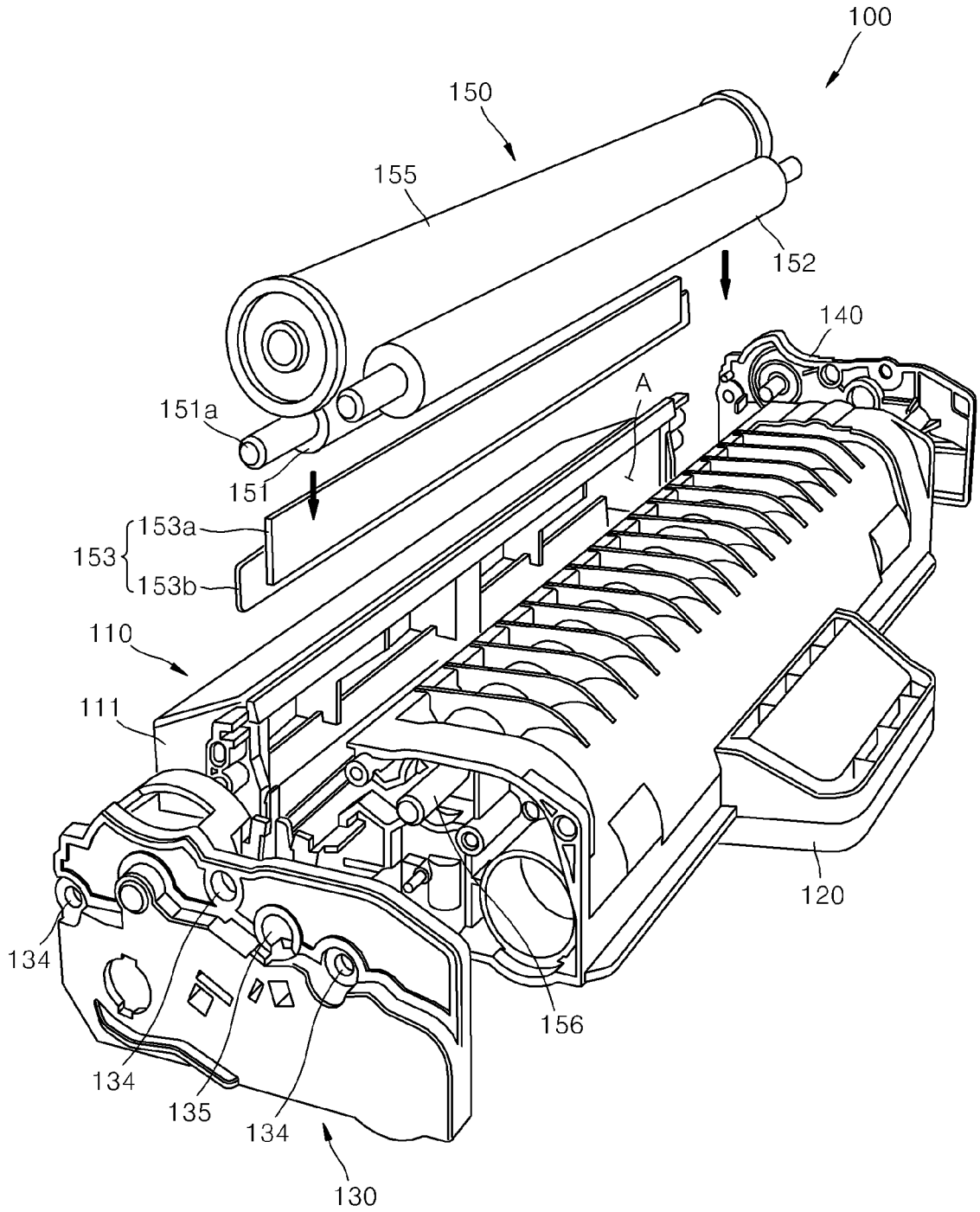
FIG. 6 is a rear side perspective view illustrating a developing cartridge according to the present general inventive concept.
Figure 7:
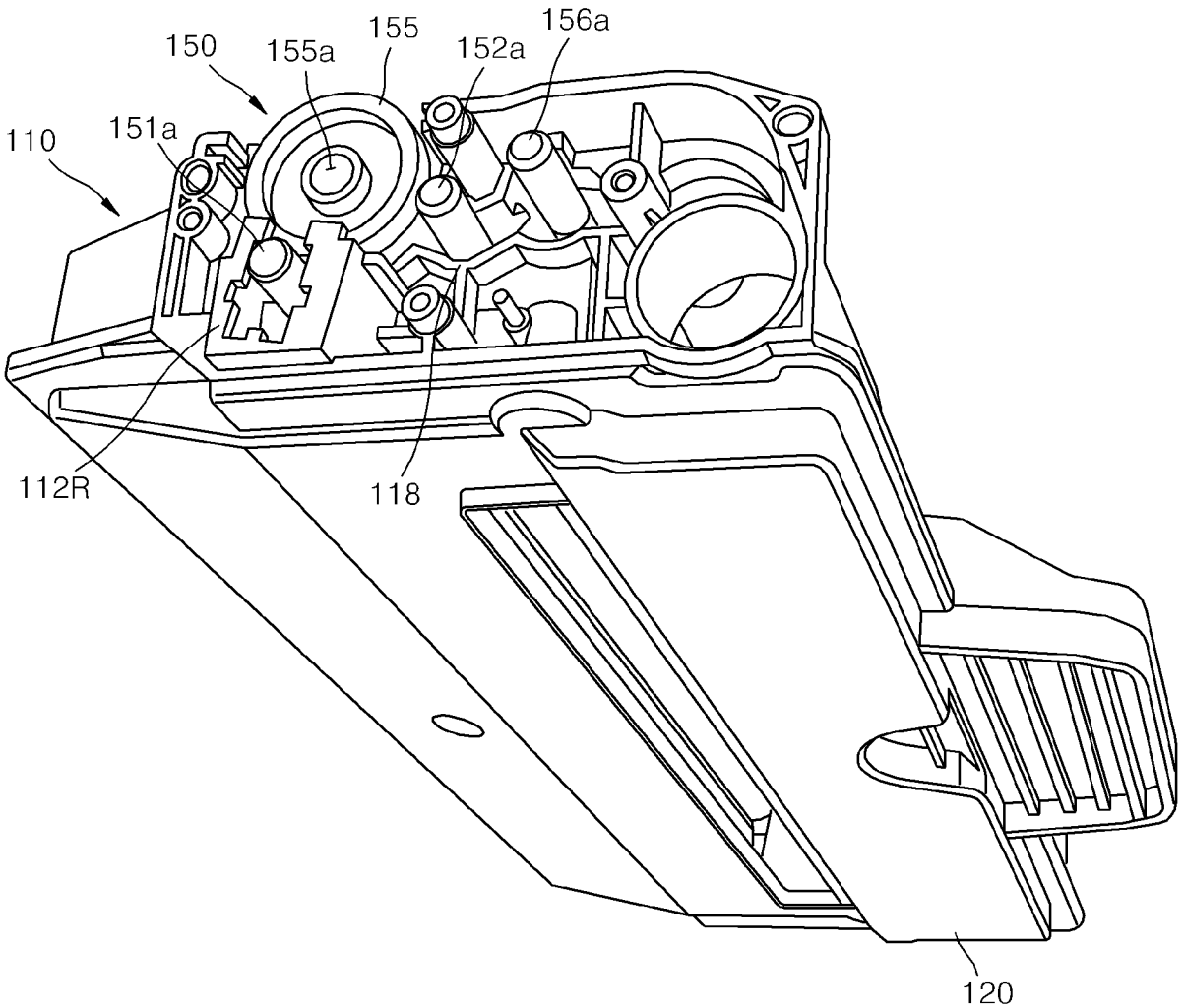
FIG. 7 is a lateral side perspective view before mounting a side frame in the developing cartridge in FIG. 6.
Figure 8:
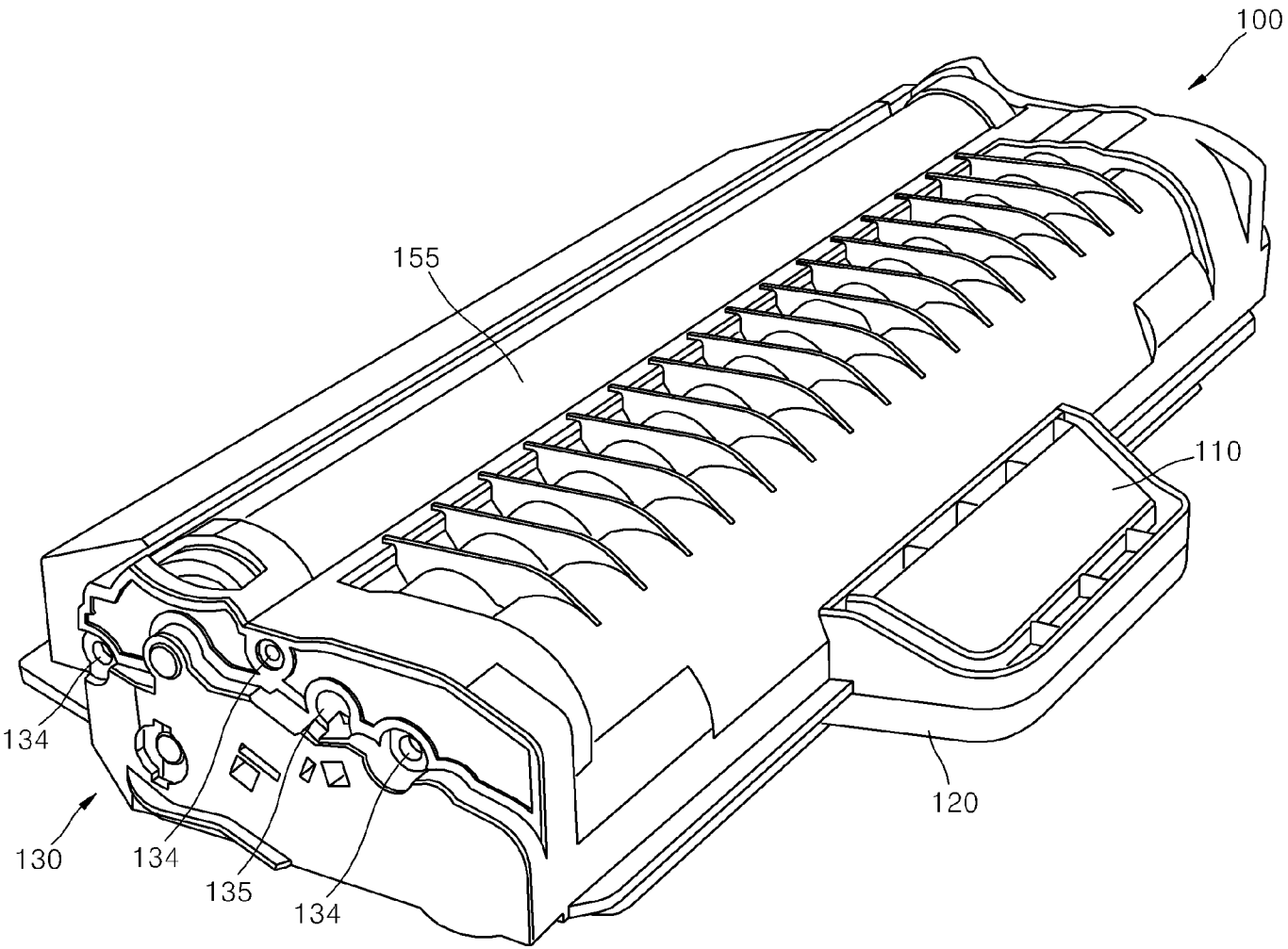
FIG. 8 is a lateral side perspective view after mounting a side frame in the developing cartridge in FIG. 7.

As illustrated in FIGS. 6 to 8, the developing cartridge 100 according to the present general inventive concept comprises a supporting casing 110, a cover casing 120, a right side frame 130, a left side frame 140, and an accommodated component 150.

Here, FIGS. 6 to 12B are rear side perspective views, and their viewing angles are reversed upside down in comparison with the perspective view in FIG. 1.

As illustrated in FIGS. 6 to 9, the supporting casing 110 comprises an accommodating main body 111 in which an attaching and detaching opening A used commonly to attach and detach the accommodated component 150 (to be described later) is formed and supporting units 112R, 117, and 118 which are provided in the accommodating main body 111 to support the accommodated component 150.

Figure 2:
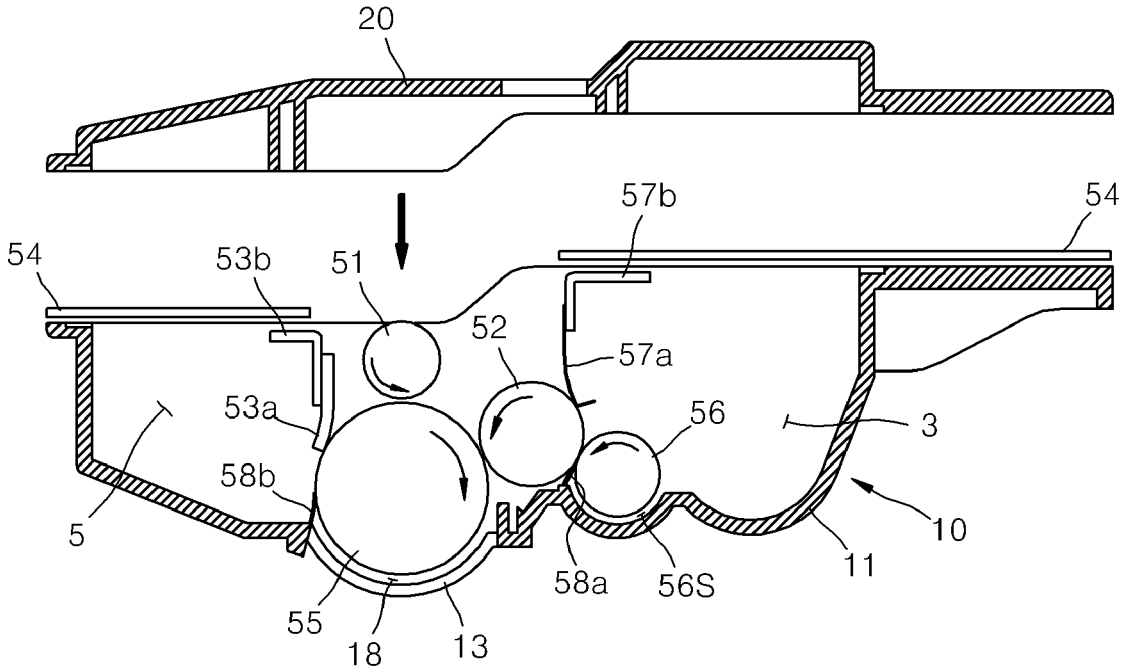
FIG. 2 (RELATED ART)
FIG. 2 is a schematic sectional view illustrating the developing cartridge in FIG. 1.
Figure 3:
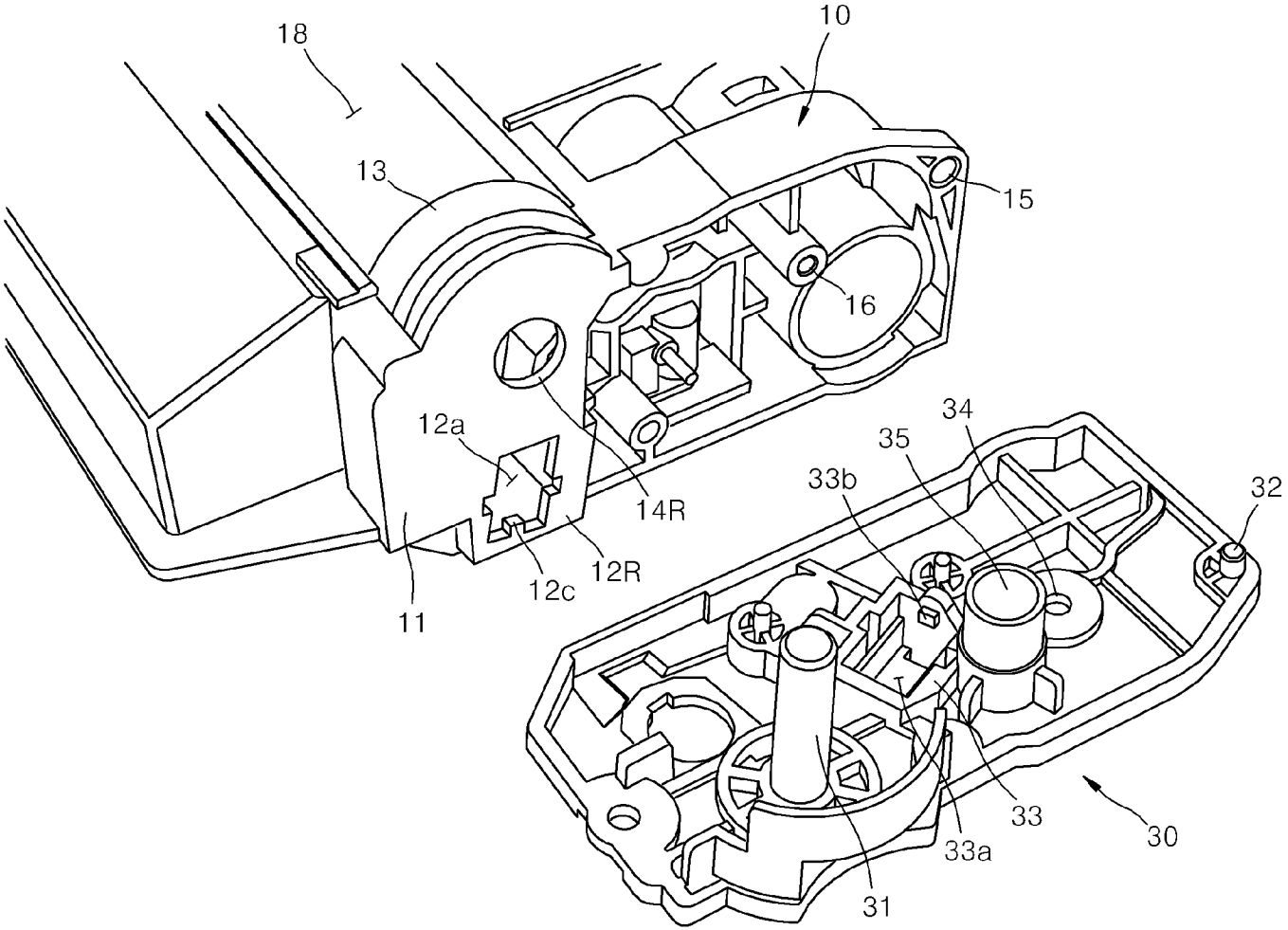
FIG. 3 (RELATED ART)
FIG. 3 is an enlarged perspective view illustrating a right rear side of the developing cartridge in FIG. 1.

The accommodating main body 111 stores toner and waste toner in its inside, and accommodates the accommodated component 150. Also, for example, the attaching and detaching opening A may be provided by removing the photosensitive body supporting plate 13 (FIGS. 2 and 3) in the transfer opening 18 (FIGS. 2 and 3) of the conventional developing cartridge 1 (FIGS. 2 and 3). That is, the attaching and detaching opening A may be formed in the transfer opening 18. Accordingly, an additional toner sealing configuration necessary to provide the attaching and detaching opening in another position is not needed.

Also, the attaching and detaching opening A is provided to be large enough so that the largest component of the accommodated components 150 can pass through. As illustrated in FIG. 6, for example, since the photosensitive body 155 is the largest, a width of the attaching and detaching opening A may be provided to be larger than a diameter of the photosensitive body 155.

Figure 9:
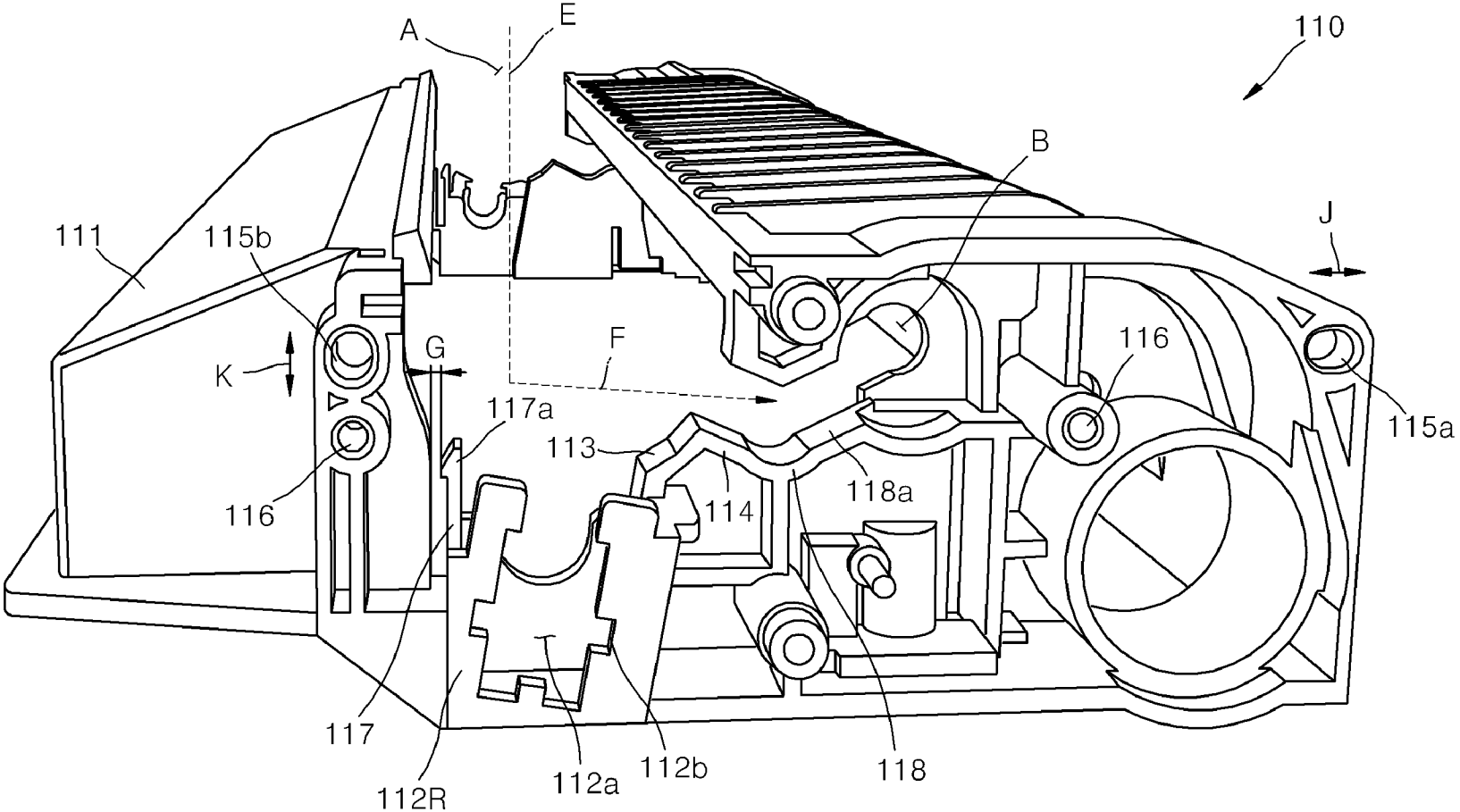
FIG. 9 is a lateral side perspective view illustrating a supporting casing of the developing cartridge in FIG. 6.

In addition, as illustrated in FIG. 9, the accommodating main body 111 is provided not to be interfered with by any component on a moving route of the accommodated component 150 so that the accommodated components 150 can move along linear mounting paths (see C in FIGS. 12A, and D, E and F in FIG. 11A) to be installed in the corresponding supporting units 112, 117 and 118 of the accommodating main body 111.

The accommodated component 150 may be provided with a consumable component which needs a durability control in the developing cartridge 100. That is, the accommodated component 150 may be provided with a component that needs to be replaced because of its short lifetime of components accommodated in the developing cartridge 100. As illustrated in FIG. 2, in an embodiment of the present general inventive concept, the doctor blade 57*a* and the bracket 57*b* supporting the doctor blade 57*a* may be excluded from the accommodated component 150 as they have a long lifetime.

Also, the accommodated component 150 may be provided with components frequently removed in manufacturing the developing cartridge 100 due to a high defective rate, as necessary. The accommodated component 150 may be selected in consideration of various conditions by a manufacturer. In an embodiment, the whole components inside the developing cartridge 100 may be selected as the accommodated component 150.

As illustrated in FIG. 6, the accommodated component 150 may comprise a photosensitive body 155 to form an electrostatic latent image by exposure, a charging roller 151 to charge the surface of the photosensitive body 155 to a predetermined electric potential, a developing roller 152 to develop the electrostatic latent image by toner, a supplying roller 156 which is accommodated in a toner storing room (not illustrated) to frictionally charge toner and supply the toner to the developing roller 152, and a cleaning unit 153.

As illustrated in FIG. 6, the cleaning unit 153 comprises a cleaning blade 153*a* to scrape and clean waste toner remaining on the surface of the photosensitive body 155 without being transferred, being in contact with the surface of the photosensitive body 155, and a blade supporting plate 153*b* which supports the cleaning blade 153*a*. The blade supporting plate 153*b* may be provided in a flat shape as illustrated in FIG. 6.

Figure 12A:
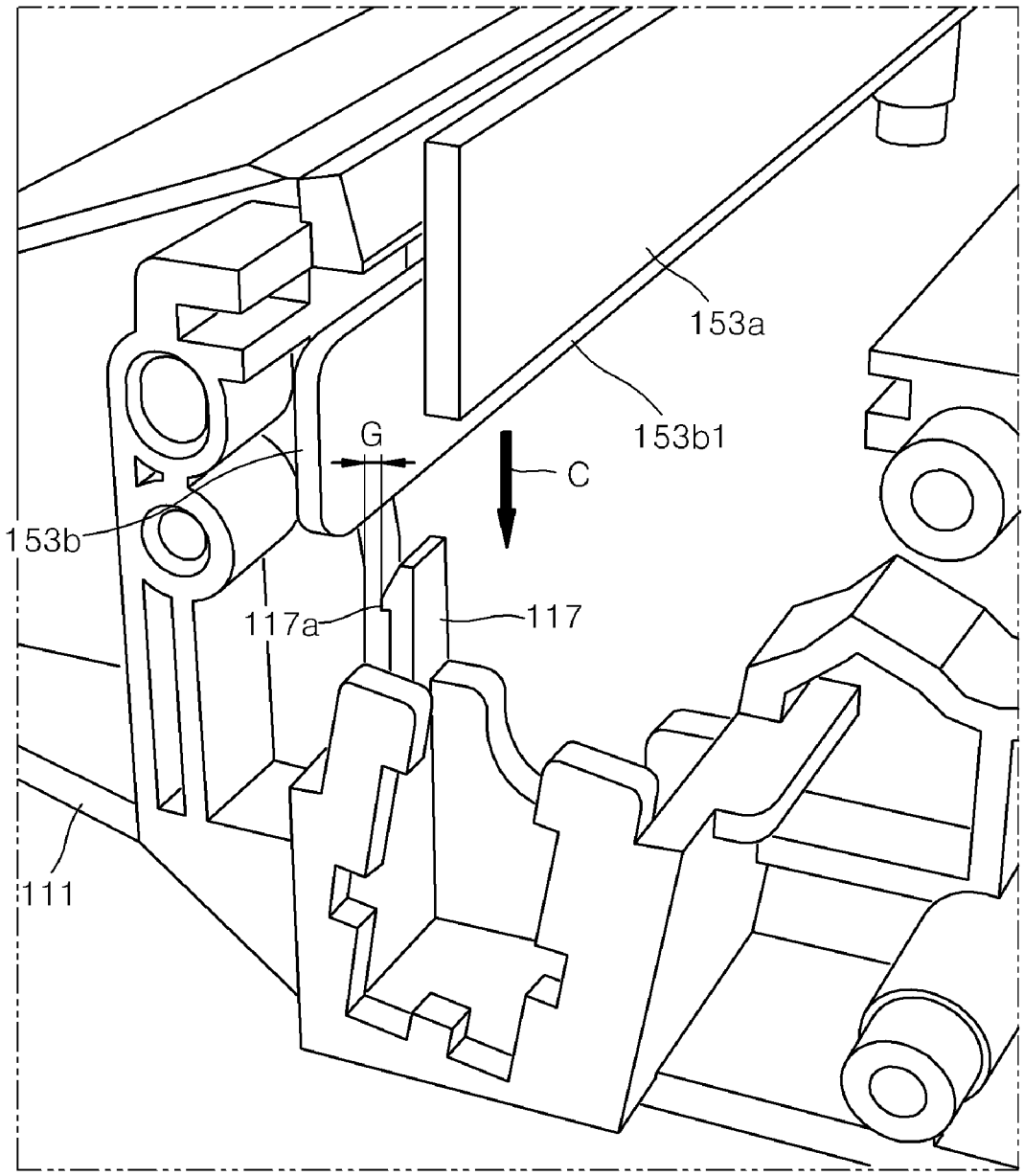
FIGS. 12A and 12B are lateral side perspective views before and after mounting a cleaning unit of the developing cartridge in FIG. 6 to the supporting casing.
Figure 12B:
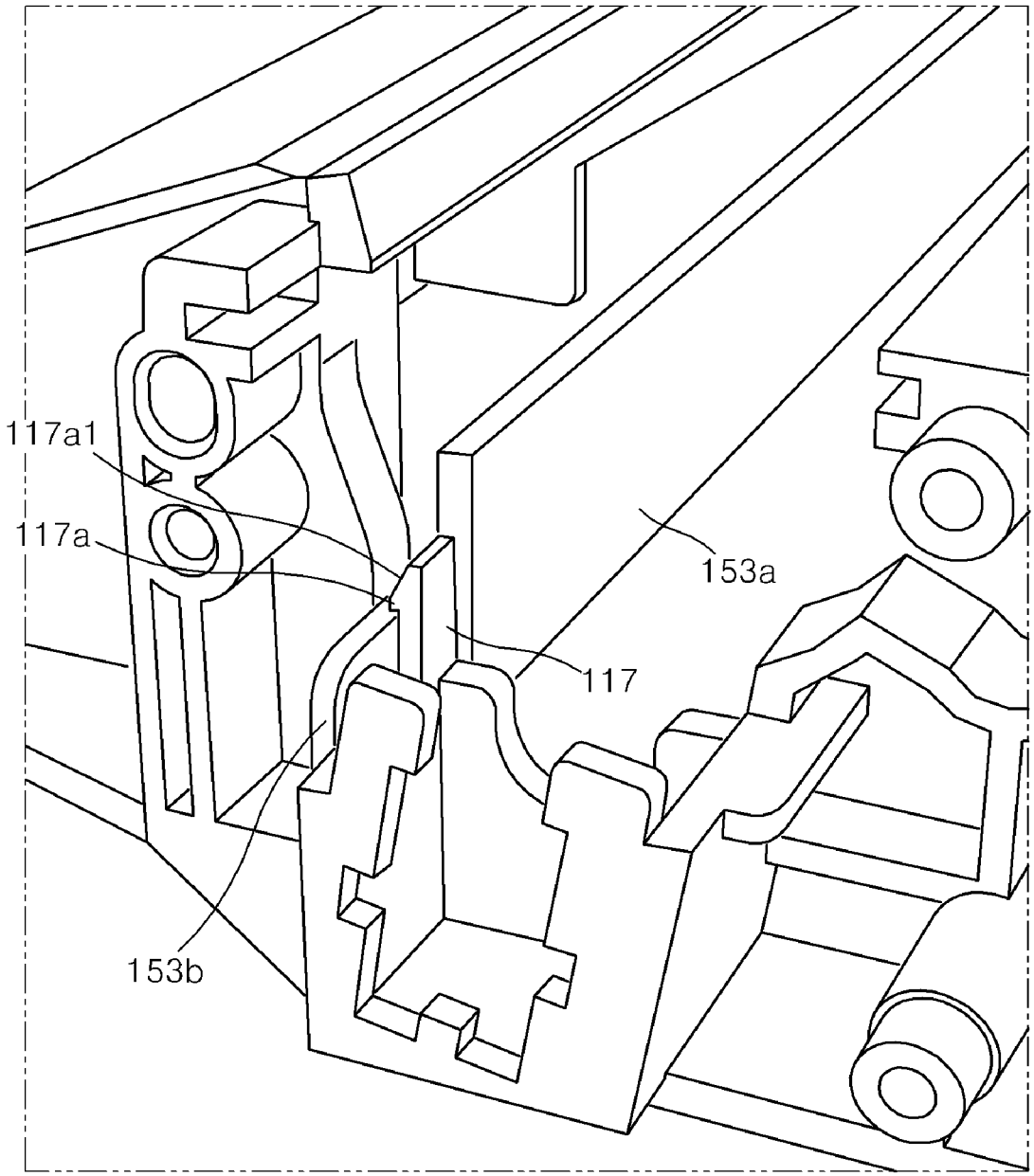

Meanwhile, as illustrated in FIGS. 9, 12A and 12B, the supporting casing 110 comprises a plurality of blade supporting units 117 which are provided on the right and the left side of the accommodating main body 111 to support the cleaning unit 153. The blade supporting units 117 may be provided to be projected toward the attaching and detaching opening A, the projection being distanced apart from the accommodating main body 111 at a predetermined interval G. In the end portion of the side of the attaching and detaching opening A of the blade supporting units 117 may be provided with a coupling projection 117*a* on which the blade supporting plate 153*b* is hooked.

Referring to FIGS. 12A and 12B, the coupling projection 117*a* may have a guide inclining face 117*a*1 to guide the blade supporting plate 153*b* at the interval G if the end portion 153*b*1 of an entering side of the attaching and detaching opening A of the blade supporting plate 153*b* is contacted with the blade supporting units 117. The interval G may be determined properly in consideration of a thickness of the blade supporting plate 153*b*.

As illustrated in FIG. 12A, if the blade supporting plate 153*b* is moved to pass through the attaching and detaching opening A toward the interval G the cleaning unit 153 is hitching-coupled by the coupling projection 117*a* to be assembled in the supporting casing 110 as illustrated in FIG. 12B. If the blade supporting plate 153*b* is moved along the linear mounting path C, it can be mounted to the accommodating main body 111, and accordingly, the installing process of the cleaning unit 153 can be automated by a robot.

Figure 11A:
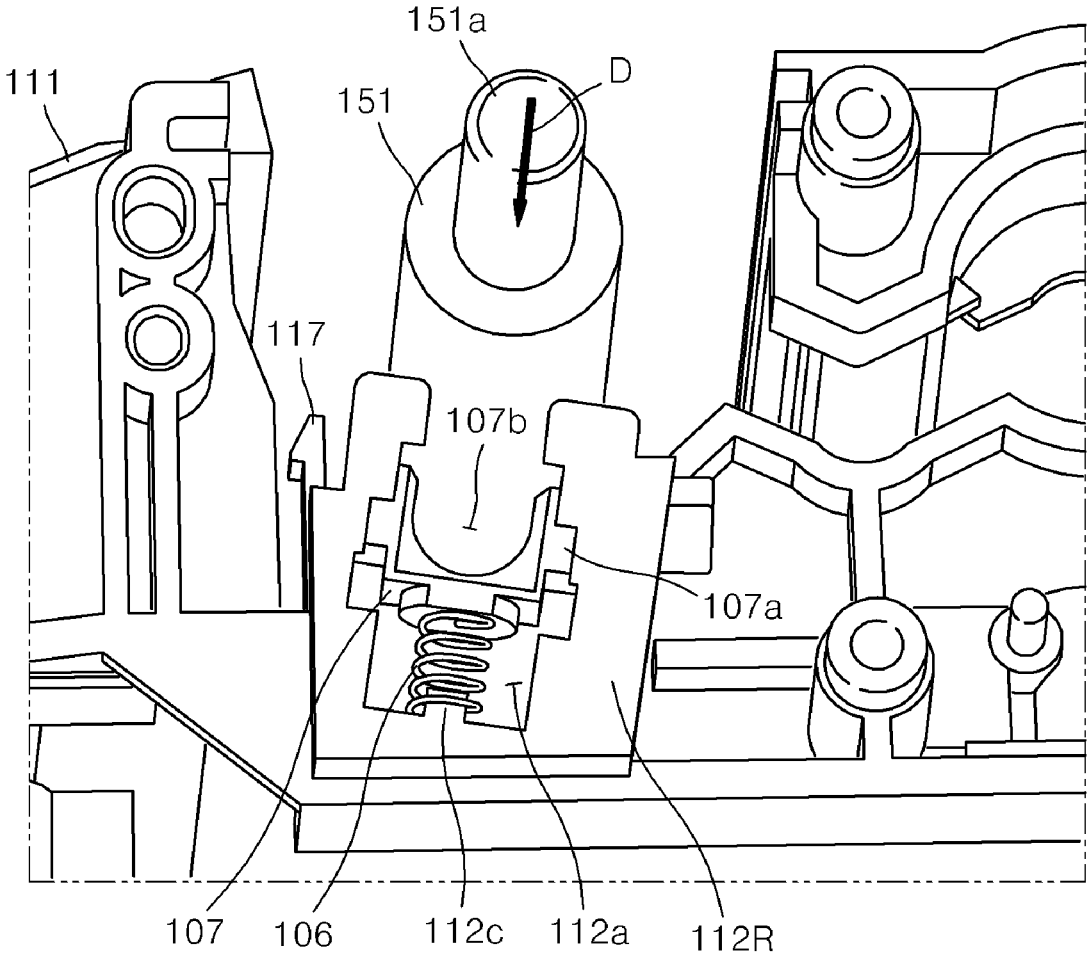
FIGS. 11A and 11B are lateral side perspective views before and after mounting a charging roller of the developing cartridge in FIG. 6 to a supporting casing.
Figure 11B:
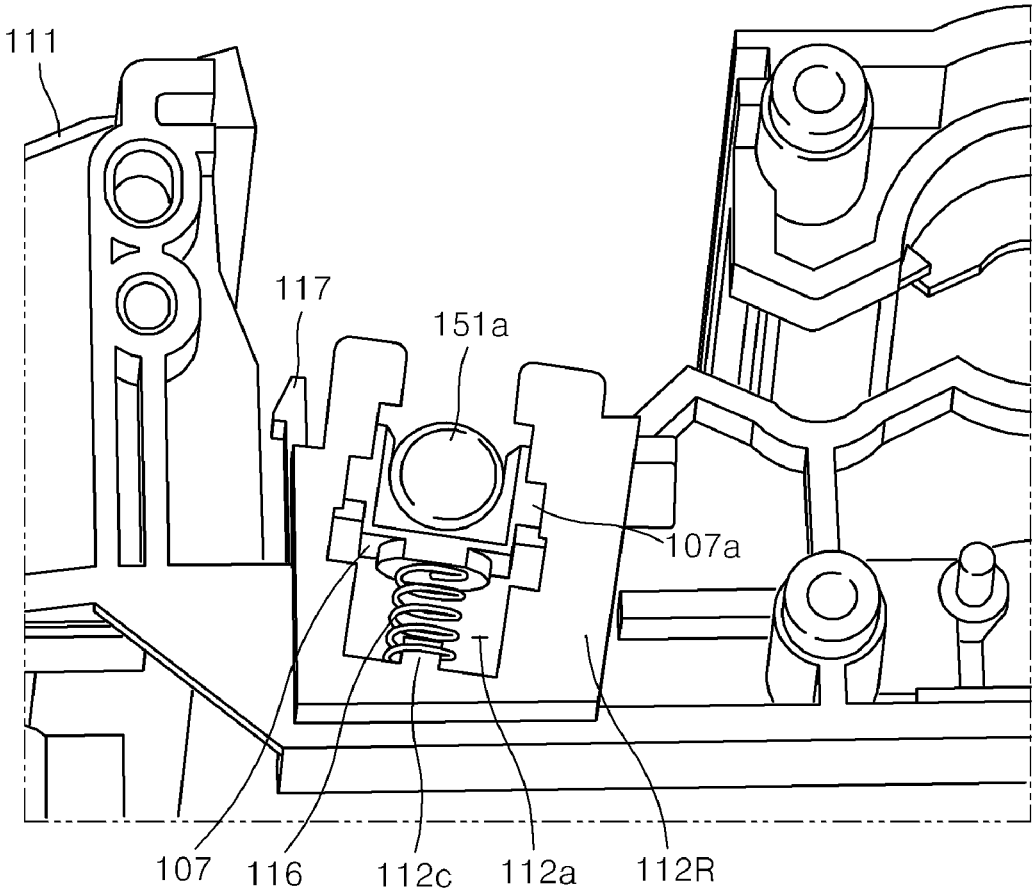

Meanwhile, as illustrated in FIGS. 9, 11A and 11B, the supporting casing 110 comprises a charging roller supporting unit 112R that is provided on the right and the left side of the accommodating main body 111, respectively, to support the charging roller shaft 151*a*. Since the left charging roller supporting unit (not illustrated) is the same as the right charging roller supporting unit 112R, only the right charging roller supporting unit 112R will be described hereinafter.

Figure 4:
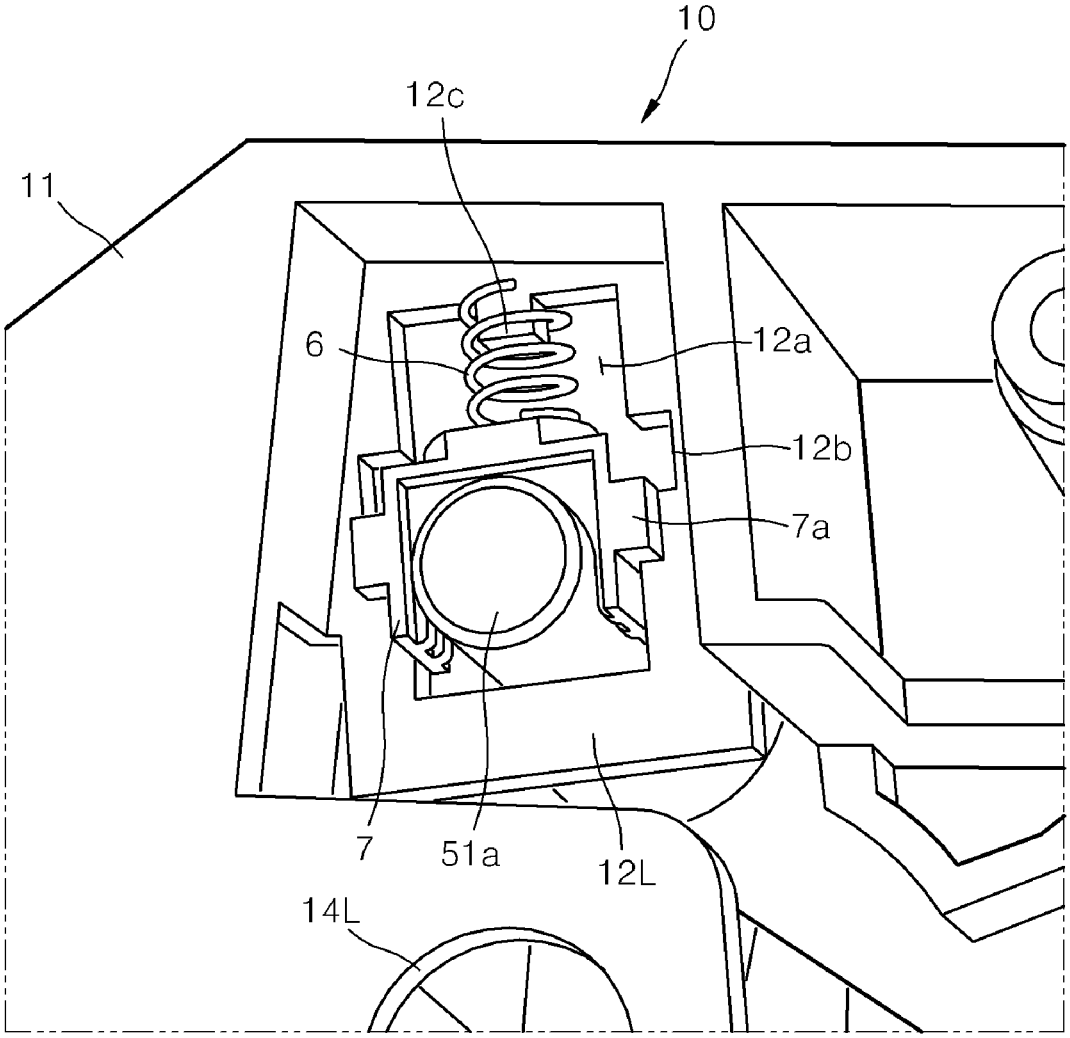
FIG. 4 (RELATED ART)
FIG. 4 is a left side enlarged perspective view illustrating the developing cartridge in FIG. 1.
Figure 5:
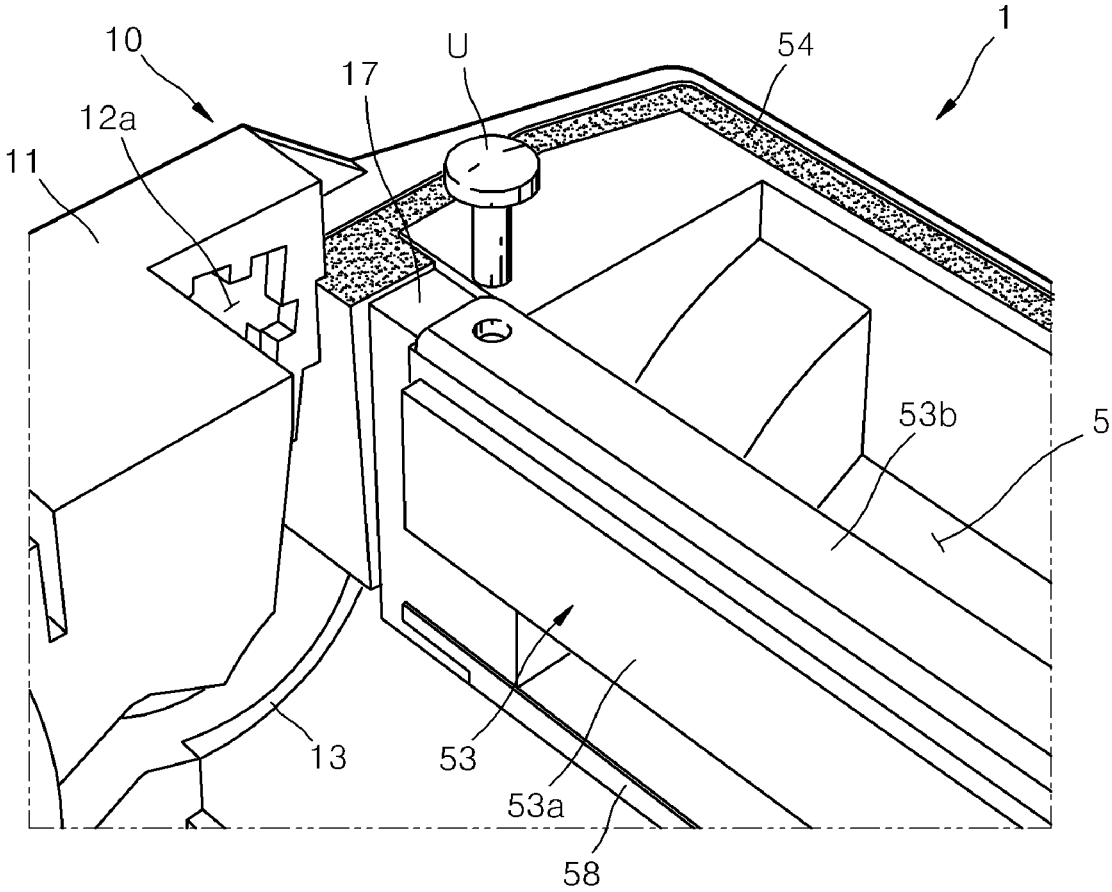
FIG. 5 (RELATED ART)
FIG. 5 is a main unit perspective view illustrating a coupling method of a cleaning blade of the developing cartridge in FIG. 1.

As illustrated in FIGS. 9 and 11B, the charging roller supporting unit 112R has a through hole 112*a* which is opened toward the attaching and detaching opening A, and into which the charging roller shaft 151*a* is inserted. On opposite sides of the through hole 112*a* is provided a groove 112*b* in a shape corresponding to a separation preventing projection 107*a* to prevent the charging roller shaft bushing 107 from being separated in an axial direction. Here, as illustrated in FIGS. 3 and 4, the conventional charging roller supporting unit 112R could not open a lower side so as to prevent the developing roller shaft 51*a* from being separated from the charging roller supporting unit 112R by self-weight.

Referring to FIGS. 11A and 11B, in the charging roller supporting unit 112R is installed a first elastic member 106 to elastically support the charging roller 151 toward the photosensitive body 155. The first elastic member 106 can be provided as a coil spring. One end portion of the first elastic member 106 is coupled to a first elastic member supporting projection 112*c* of the charging roller supporting unit 112R. The other end portion of the first elastic member 106 is coupled to the charging roller shaft bushing 107 to elastically support the charging roller shaft bushing 107 toward the photosensitive body 155 (FIG. 6).

Here, the charging roller shaft bushing 107 has an opening portion 107*b* opened toward the attaching and detaching opening A like the through hole 112*a* (FIG. 9) of the charging roller supporting unit 112R. If the charging roller 151 is moved along the linear mounting path D connecting the attaching and detaching opening A and the charging roller 151, the charging roller 151 can be installed in the charging roller supporting unit 112 since the charging roller supporting unit 112R and the charging roller shaft bushing 107 are opened to the attaching and detaching opening A. Accordingly, a process to mount the charging roller 151 to the accommodating main body 111 can be automated.

Here, the linear mounting path D may be provided to correspond to a gravity direction so that the charging roller 151 can be more stably supported in the charging roller supporting unit 112 during an automation process.

Meanwhile, as illustrated in FIGS. 7 and 9, the supporting casing 110 further comprises a plurality of developing roller supporting units 118 which are provided on the right and the left side of the accommodating main body 111 to support the opposite end portions of the developing roller shaft 152*a*, respectively.

So as to mount the developing roller 152 to the accommodating main body 111, after the developing roller 152 passes through the attaching and detaching opening A, the developing roller 152 is moved to the developing roller supporting unit 118 along a linear mounting path E and a bending mounting path F bent from the linear mounting path E. Here, a bending guide 114 may be provided to guide the developing roller 152 so that the developing roller 152 can move along the bending mounting path F.

Referring to FIGS. 6 and 9, the supplying roller 156 may be first installed in the accommodating main body 111 ahead of installing the developing roller 152 in the accommodating main body 111.

Here, in the accommodating main body 111 is formed a supplying roller shaft through hole B which is extended from the developing roller supporting units 118 and through which a supplying roller shaft 156*a* passes. The supplying roller shaft through hole B is provided in a proper position so that the developing roller 152 and the supplying roller 156 can rotate in the same direction to frictionally charge toner.

As illustrated in FIG. 9, the supplying roller shaft through hole B and the developing roller supporting units 118 can be connected through an inclined surface 118*a* inclined toward the developing roller supporting unit 118. Accordingly, although the supplying roller 156 is designed to be moved to the supplying roller shaft through hole B, the supplying roller 156 moves to the developing roller supporting unit 118 by self-weight.

Accordingly, so as to install the supplying roller 156 in the accommodating main body 111, the supplying roller 156 may be installed in the developing roller supporting unit 118 by moving the supplying roller 156 in the same method as the installing process of the developing roller 152. At this time, if the developing roller 152 is moved to the developing roller supporting unit 118 in a state in which the supplying roller 156 has been first installed, the supplying roller 156 is automatically moved to a position in the supplying roller shaft through hole B along the inclined surface 118*a* with the supplying roller 156 being contacted with the developing roller 152.

Accordingly, the installing process of the supplying roller 156 and the developing roller 152 in the accommodating main body 111 can be automated.

So far, the process in which each of the accommodated components 151, 152, 153, and 155 is installed in the supporting casing 110, more particularly, the accommodating main body 111, has been described in detail.

Hereinafter, an entire assembling process of the developing cartridge 100 will be described by referring to FIGS. 7 and 9.

First, the other components which are not selected as an accommodated component 150 in the supporting casing 110, that is, the components which do not need to be detachably provided, such as the doctor blade 57*a* (FIG. 2) and the bracket 57*b* (FIG. 2) supporting the doctor blade 57*a* are installed in the supporting casing 110.

Then, the cover casing 120 is coupled to the supporting casing 110 to cover up a border of the waste toner storing room and the toner storing room. The cover casing 120 and the supporting casing 110 may be coupled by welding. At this time, the cover casing 120 and the supporting casing 110 may be fixedly coupled in an ultrasonic welding or a vibration welding method so as not to use a sealing member. Accordingly, there is not needed an additional sealing member, thereby reducing a component cost. Also, although an inferior component is detected among the accommodated components 150, the concerned component can be easily detached through the attaching and detaching opening A without separating the cover casing 120 and the supporting casing 110, thereby reducing a number of work points and a manufacturing cost.

The cover casing 120 and the supporting casing 110 may be provided as an integrated body, as necessary.

After the cover casing 120 is fixedly coupled to the supporting casing 110, the accommodated component 150 is installed in the supporting units 112, 117 and 118 of the corresponding accommodated component 150, provided in the accommodating main body 111.

As illustrated in FIGS. 11A to 12B, the cleaning unit 153 or the charging roller 151 are installed in the accommodating main body 111 in an arbitrary order. The cleaning unit 153 is installed in the blade supporting units 117, and the charging roller 151 is installed in the charging roller supporting unit 112.

Further, the supplying roller 156 is installed in the developing roller supporting unit 118 of the accommodating main body 111. If the developing roller 152 is installed in the developing roller supporting unit 118 in the above state, the supplying roller 156 is contacted with the developing roller 152 to be installed in a position of the developing roller shaft through hole B along the inclined surface 118*a* (FIG. 9).

After that, if the photosensitive body 155 is put on the charging roller 151, some portions of the circumference surface of the photosensitive body 155 are contacted with the charging roller 151, and other portions are contacted with the photosensitive body supporting unit 113, and accordingly, the photosensitive body 155 is installed in the accommodating main body 111.

As described above, central points of the rotational shafts of the accommodated components 151, 152, 155, and 156 except for the cleaning unit 153 are not fixedly coupled, but they are put in a movable state. Accordingly, the right and the left side frames 130 and 140 are coupled to the both sides of the supporting casing 110 so as to determine the position of the central points of the rotational shafts.

The side frames 130 and 140 are coupled to the supporting casing 110 in the manufacturing process of the developing cartridge 100. For this purpose, the shapes and the coupling methods of the accommodating main body 111 and the side frame 130 will be described by referring to FIG. 10. Here, since the accommodating main body 111 is provided to be symmetrical, and the left side frame 140 is provided in the shape corresponding to the right side frame 130, only the method in which the right side frame 130 is coupled to the right surface of the accommodating main body 111 will be described.

Figure 10:
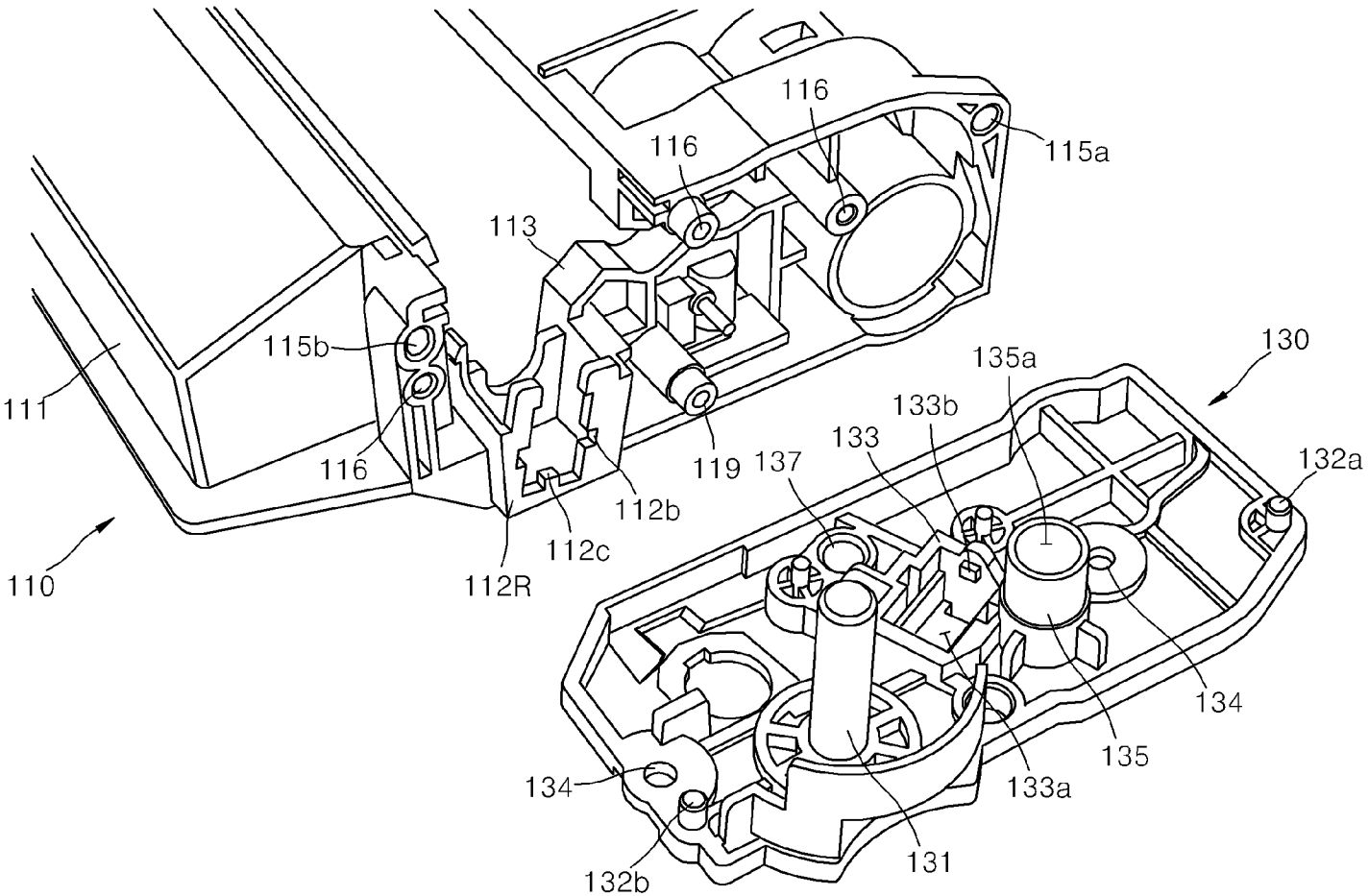
FIG. 10 is an enlarged perspective view illustrating main units of a supporting casing and a right side frame in the developing cartridge in FIG. 6.

As illustrated in FIG. 10, on the right side of the accommodating main body 111 are formed a casing position determining projection 119, a first position determining hole 115*a* and a second position determining hole 115*b*.

Here, as illustrated in FIG. 9, the first position determining hole 115*a* may be provided as a long hole in a transverse direction (a direction J) of the accommodating main body 111, and the second position determining hole 115*b* may be provided as a long hole in a vertical direction K of the accommodating main body 111.

Referring to FIGS. 7 and 10, in the right side frame 130 are provided a photosensitive body inserting boss 131 which is inserted into a photosensitive body shaft hole 155*a* of the photosensitive body 155 to be a rotational central point of the photosensitive body 155, and a supplying roller shaft supporting unit 135 which has a shaft hole 135*a* into which a supplying roller shaft 156*a* is inserted.

Also, in the right side frame 130 is provided a position determining hole 137 into which a casing position determining projection 119 is inserted to determine a relative position of the right side frame 130 and the accommodating main body 111. Also, the first and the second side position determining projections 132*a* and 132*b* that are inserted into the first position determining hole 115*a* and the second position determining hole 115*b* are additionally provided in the right side frame 130.

Meanwhile, the relative position may be determined in various ways in place of the above-described configuration to determine the relative position of the right side frame 130 and the accommodating main body 111. For example, a position determining projection, and the number, the shape, and the arrangement of the position determining hole corresponding to the position determining projection may be properly changed, as necessary.

Also, in the right side frame 130 is provided a developing roller position determining unit 133 to determine the position of the right end portion of the developing roller shaft 152*a* (FIG. 7).

The developing roller position determining unit 133 comprises a developing roller shaft bushing (not illustrated) which rotatably supports the right end portion of the developing roller shaft 52*a* in FIG. 1, a second elastic member (not illustrated), a second elastic member supporting projection 133*b*, an accommodating room 133*a* which accommodates the developing roller shaft bushing, the second elastic member, and the second elastic member supporting projection 133*b*.

The second elastic member is provided to apply an elastic force to the developing roller shaft bushing (not illustrated) toward the photosensitive body inserting boss 131. Also, in the second elastic member supporting projection 133*b*, one end portion of the second elastic member (not illustrated) is installed.

Hereinafter, an assembling process of the right side frame 130 and the supporting casing 110 having the above configuration will be described. First, the position determining hole 137 of the right side frame 130 is inserted into the casing position determining projection 119 formed on the right side of the accommodated main body 111 in a state that the accommodated component 150 has been mounted. At the same time, for example, the photosensitive body inserting boss 131 is inserted into the photosensitive body shaft hole 155*a* (FIG. 7), the supplying roller shaft 156*a* (FIG. 7) is inserted into the shaft hole 135*a* of the supplying roller shaft supporting unit 135, and the developing roller shaft 152*a* (FIG. 7) is inserted into the developing roller shaft bushing (not illustrated) of the developing roller position determining unit 133. Also, at the same time, for example, the first and the second side position determining projections 132*a* and 132*b* are inserted into the first and the second position determining hole 115*a* and 115*b*, respectively.

Further, the left side frame 140 is inserted into the left side of the accommodating main body 111 in the same method as the right side frame 130. The right and the left side frames 130 and 140 may be installed in the accommodating main body 111 at the same time, or they may be sequentially installed, as necessary.

Accordingly, the rotational central position of the photosensitive body 155, the developing roller 152, and the supplying roller 156 is determined by the right and the left side frames 130 and 140.

Furthermore, since the first and the second position determining holes 115*a* and 115*b* are provided in the shape of a long hole, the position of the right and the left side frames 130 and 140 can be precisely controlled in the state that the right and the left side frames 130 and 140 are rotatably supporting the photosensitive body 155, the developing roller 152, and the supplying roller 156 to rotate.

After the position is controlled, the right and the left side frames 130 and 140 are coupled to the accommodating main body 111 by using a coupling tool such as a bolt at the position of the coupling holes 134 and 116 formed to correspond to each other. Accordingly, if there is a need to replace some of the accommodated component 150, the accommodated component 150 can be easily detached by separating only the right and the left side frames 130 and 140 without separating the cover casing 120.

The electrophotographic image forming apparatus (not illustrated) according to the present embodiment comprises a main body (not illustrated), a developing cartridge 100 (FIG. 8) which is detachably provided in the main body, a transferring unit (not illustrated) which is disposed in parallel with the photosensitive body 155 (FIG. 6) of the developing cartridge 100, and a medium feeding unit which feeds a printing medium between the transferring unit and the photosensitive body 155.

Also, the image forming apparatus further comprises a light scanning unit (LSU, not illustrated) which exposes the surface of the photosensitive body 155 (FIG. 6), a fusing unit (not illustrated) which fuses toner on the printing medium by heat and pressure, and a power supplying source (not illustrated) and a rotational driving source (not illustrated) which supply power and a rotational force to the accommodated component 150 of the developing cartridge 100 respectively if the developing cartridge 100 is mounted.

Hereinafter, a printing process of the image forming apparatus having the above configuration will be briefly described. First, if power and a rotational driving force are applied to the charging roller 151 (FIG. 6), the surface of the photosensitive body 155 (FIG. 6) is uniformly contact-electrified to rotate in a predetermined electric potential.

If the light scanning unit scans light corresponding to image information onto the surface of the photosensitive body 155, the surface of the photosensitive body 155 is exposed to form an electrostatic latent image thereon. The electrostatic latent image is developed by toner frictionally electrified by the supplying roller 156 (FIG. 6) and the developing roller 152 (FIG. 6). The toner is moved to the developing roller 152 by the supplying roller 156 accommodated in the toner storing room inside the developing cartridge.

Also, if the toner is spread on the electrostatic latent image, the toner visible image formed on the surface of the photosensitive body 155 is transferred to the printing medium by the transferring unit (not illustrated) disposed in parallel with the photosensitive body 155. The medium feeding unit (not illustrated) feeds the printing medium in a proper time so that the toner visible image can be transferred in an image forming area on the printing medium.

The toner visible image transferred to the printing medium is fused by the fusing unit (not illustrated) and the fused printing medium is discharged to the outside, and accordingly, printing is completed.

As described above, the developing cartridge and the image forming apparatus having the developing cartridge according to the present general inventive concept have effects as follows.

First, only side frames can be separated without separating a cover casing so as to detach an accommodated component, thereby easily detaching the accommodated component through an attaching and detaching opening.

Second, the number of assembling points can be reduced in assembling the developing cartridge. Since the cleaning unit can be coupled without installing an additional sealing member, the cleaning unit can be easily mounted to an accommodating main body of the developing cartridge. Also, the charging roller can be mounted to the accommodating main body along the linear mounting path, thereby obtaining a better working efficiency in comparison with the inclining-working of the conventional charging roller.

Third, a developing cartridge assembling process can be automated. That is, the assembling process can be automated by a robot by changing the shapes of the accommodating main body and the accommodated component supporting unit in place of the conventional hand working.

Fourth, since the accommodated component of the developing cartridge can be easily replaced with a new one, the components of the developing cartridge except for the accommodated component can be recycled, thereby obtaining an ecological effect.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A casing for a developing cartridge, comprising:

an accommodating main body having a first opening through which at least two components of a photosensitive body, a developing unit to develop the photosensitive body by toner, a cleaning unit to clean waste toner attached to the photosensitive body and a charging unit to charge the photosensitive body can pass in common; and a supporting unit integrally formed with the accommodating main body to support the components accommodated inside the accommodating main body.

2. The casing according to claim 1, wherein the accommodating main body has a second opening which is opened to an opposite side of the first opening, and further comprising a cover casing to close the second opening.

3. The casing according to claim 2, wherein the cover casing and the accommodating main body are coupled by at least one of welding, ultrasonic welding, vibration welding and adhesion.

4. The casing according to claim 1, wherein the accommodating main body is provided so that the accommodated components can move from the first opening to a supporting position of the supporting unit along a linear mounting path.

5. The casing according to claim 4, wherein the accommodating main body comprises a guide to guide at least one of the accommodated components to the supporting position along the linear mounting path.

6. The casing according to claim 5, wherein the guide comprises a bending guide to guide at least one of the accommodated components along a bending mounting path bent from the linear mounting path.

7. The casing according to claim 1, further comprising a plurality of side frames which rotationally support a rotational body and which are detachably coupled to opposite sides of the supporting casing.

8. The casing according to claim 1, wherein the first opening is a transfer opening in which the photosensitive body engages a print medium.

9. The casing according to claim 1, wherein the support unit is configured to receive the components having passed through the first opening and to support the received components.

10. A developing cartridge, comprising:

a plurality of components which comprises at least two of a photosensitive body, a developing unit to develop the photosensitive body by toner, a cleaning unit to clean waste toner attached to the photosensitive body, and a charging unit to charge the photosensitive body; and a supporting casing which comprises an accommodating main body having a first opening through which at least two of the plurality of components can pass in common, and a supporting unit integrally formed with the supporting casing to support the components accommodated inside the accommodating main body.

11. The developing cartridge according to claim 10, wherein the accommodating main body has a second opening which is opened to an opposite side of the first opening, and further comprising a cover casing to close the second opening.

12. The developing cartridge according to claim 11, wherein the cover casing and the accommodating main body are coupled by an ultrasonic or a vibration welding or adhesion.

13. The developing cartridge according to claim 10, wherein the accommodating main body is provided so that the accommodated components can move from the first opening to a supporting position of the supporting unit along a linear mounting path.

14. The developing cartridge according to claim 13, wherein the accommodating main body comprises a guide to guide at least one of the accommodated components to the supporting position along the linear mounting path.

15. The developing cartridge according to claim 14, wherein the guide comprises a bending guide to guide at least one of the accommodated components along a bending mounting path bent from the linear mounting path.

16. The developing cartridge according to claim 10, wherein the plurality of components comprise the cleaning unit and the photosensitive body;

the cleaning unit comprises a cleaning blade to contact a surface of the photosensitive body, and a blade supporting plate to support the cleaning blade, and the supporting unit comprises a blade supporting unit coupled to the blade supporting plate.

17. The developing cartridge according to claim 10, wherein the plurality of components comprise the photosensitive body, the developing unit and the charging unit;

the photosensitive body has a photosensitive body shaft;

the developing unit comprises a developing roller having a developing roller shaft in parallel with the photosensitive body shaft; and the charging unit comprises a charging roller which has a charging roller shaft in parallel with the photosensitive body shaft and contact-charges the photosensitive body.

18. The developing cartridge according to claim 17, further comprising a plurality of side frames to rotationally support the photosensitive body shaft, the developing roller shaft, and the charging roller shaft and which are detachably coupled to opposite sides of the supporting casing.

19. The developing cartridge according to claim 18, further comprising:

a plurality of position determining projections which are provided in at least one of the side frame and the supporting casing to determine the relative position of the side frame with respect to the supporting casing; and a plurality of position determining holes which are provided in the other one of the side frame and the supporting casing and into which the position determining projection is inserted.

20. The developing cartridge according to claim 19, wherein at least one of the plurality of position determining holes is provided as an elongated hole.

21. The developing cartridge according to claim 17, further comprising an elastic member to elastically support the charging roller shaft toward the photosensitive body.

22. An image forming apparatus having a main body, the apparatus comprising:

a developing cartridge accommodated in the main body, the developing cartridge comprising:

a photosensitive body;

a developing unit to develop the photosensitive body by toner;

a cleaning unit to clean waste toner attached to the photosensitive body, the cleaning unit including a cleaning blade to contact a surface of the photosensitive body, and a blade supporting plate to support the cleaning blade;

a charging unit to charge the photosensitive body; and a supporting casing which comprises an accommodating main body having a first opening through which at least two components of the photosensitive body, the developing unit, the cleaning unit and the charging unit can pass in common, and a supporting unit integrally formed with the support casing to support the components accommodated inside the accommodating main body having a blade supporting unit coupled to the blade supporting plate; and a transferring unit to face the photosensitive body of the developing cartridge; and a medium feeding unit to feed a printing medium between the photosensitive body and the transferring unit.

* * * * *